US006050063A

United States Patent [19]

Ford et al.

[11] Patent Number: 6,050,063

[45] **Date of Patent: *Apr. 18, 2000**

[54] CARTON OPENING METHOD AND APPARATUS

[75] Inventors: Colin Ford, Woodstock; Jeff Disrud, Marietta, both of Ga.

[73] Assignee: Riverwood International Corporation, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 09/129,350

[22] Filed: Aug. 5, 1998

[51] Int. Cl.[7] ..... B65B 3/02

[52] U.S. Cl. ..... 53/458; 53/381.1; 53/566; 493/315; 493/319

[58] Field of Search ..... 53/492, 458, 381.1, 53/564, 566; 493/315, 319, 318, 313, 182

[56] References Cited

U.S. PATENT DOCUMENTS

| | | | |
|---|---|---|---|
| 3,613,526 | 10/1971 | Jones | 493/313 |
| 3,783,752 | 1/1974 | Langen et al. | 493/315 |
| 4,064,675 | 12/1977 | Stapp et al. | 53/381.1 |
| 4,170,929 | 10/1979 | McDowell | 493/313 |
| 4,211,153 | 7/1980 | Walters et al. | 493/313 |
| 4,537,587 | 8/1985 | Langen | 493/318 |
| 4,871,348 | 10/1989 | Konaka | 493/315 |
| 5,061,231 | 10/1991 | Dietrich et al. | 493/315 |
| 5,155,968 | 10/1992 | Mosse et al. | 53/564 |
| 5,411,464 | 5/1995 | Calvert et al. | 493/315 |
| 5,561,968 | 10/1996 | Palmer | 53/458 |

*Primary Examiner*—Peter Vo
*Assistant Examiner*—Matthew Luby
*Attorney, Agent, or Firm*—Womble Carlyle Sandridge & Rice, PLLC

[57] ABSTRACT

A carton opening method and assembly for a continuous motion packaging machine directs opposed carton engaging plates perpendicular to opposite side walls of a collapsed carton moving through the opening assembly. A vacuum is applied to the opposed carton side walls when the assemblies engage the carton. One or more of the opposed carton engaging assemblies are retracted to fully open the carton, which is then transferred to a conveyor that transports the carton to the next workstation of the packaging machine. The carton opening operation is accomplished while tracking the carton movement through the carton opening assembly.

20 Claims, 8 Drawing Sheets

CARTON OPENING METHOD AND APPARATUS

FIELD OF THE INVENTION

This invention generally relates to a carton opening assembly for use in a continuous motion packaging machine for packaging articles such as, for example, beverage containers. More particularly, this invention is a method and apparatus for opening collapsed, paperboard, basket-type cartons in continuous fashion, so that the cartons thereafter can be transferred fully opened to a carton transport mechanism for delivery to the next workstation in the continuous motion packaging machine.

BACKGROUND OF THE INVENTION

Continuous motion article packaging machines, such as those used in the beverage packaging industry are well-known, and various types of packaging machines are constructed to accomplish the packaging of articles into different types of cartons. One such machine enables articles, such as glass or plastic bottles, to be packaged in a basket-type carton. These cartons or baskets generally are one of two forms. One basket has a pre-glued bottom and a locking system which engages when the collapsed carton is fully opened, and then holds the carton open so that the articles can be inserted into the open cells of the basket. For example, Riverwood International Corporation's Rough Rider 2000™ opening machine is used in conjunction with a basket-type drop packing machine designed to process a basket-type carton with a pre-glued base or bottom wall. The second type of basket does not have a pre-glued bottom, but instead is designed to define an opening between the side walls so that the partially assembled carton can be lowered onto a pre-configured bottle group. Once the basket is lowered around the bottle group so that the bottles are individually received within the basket side walls, flaps which initially extend from opposing side walls are folded into contact with one another to form the bottom wall of the completely assembled basket containing the articles.

Each type of continuous motion packaging machine for packaging articles into different forms of baskets are well-known. Each basket-type packaging machine, including those comprised of carton opening assemblies combined with ancillary article loading devices, includes several similar workstations. In each machine, collapsed, partially assembled baskets are fed onto a transport mechanism by a carton pick and transfer assembly, or carton feeder. The transport mechanism then moves the collapsed cartons in continuous fashion to a carton opening assembly. During the transportation of the collapsed carton from the carton feeder to the carton opening assembly, one or more of the carton flaps, or the carton itself, may be manipulated into a desired position. At the carton opening assembly, the collapsed carton is manipulated into an opened position. At the downstream end of this workstation, the subsequent handling of the opened carton and the article loading operation differs, depending upon the type of basket packaging machine utilized. In all types of these machines, however, the result of the final workstation is a fully assembled, basket-type carton carrying the packaged articles. Such packaging machines can be comprised of a unitary device having all such workstations, or can include more than one assembly linked together to include each such workstation.

In the Rough Rider 2000™ packaging machine, the collapsed carton is transported from the carton feeder on its side, and delivered to the carton opening assembly. The carton opening assembly comprises two vacuum plate assemblies which engaged opposite sides of the carton, then pull the carton into a fully opened position. The carton processed by the Rough Rider 2000™ machine includes a pre-glued bottom wall or base with toe locks which engaged the fully opened bottom wall to hold the carton or basket in a fully opened position. The basket processed by the Rough Rider 2000™ machine then is oriented to a handle up position, and transported to an ancillary article loading machine which places the articles, such as bottles, into the fully opened basket. The vacuum plate assemblies of the Rough Rider 2000™ machine include two pairs of rotating wheels or pivots, each of which moves a vacuum plate in a circular motion at a fixed velocity. The vacuum plate transcribes a walking beam motion in which every point of the vacuum plate transcribes a circle relating to the pivot radius. Ideally, the vacuum cups of the Rough Rider 2000™ opening assembly will strike the carton side wall in a direction as close to vertical, or perpendicular to the side walls as possible, at which point the vacuum is applied by vacuum lines to the vacuum cups engaging the basket side wall. As the vacuum plate continues to be moved in an arc, the upper basket side wall follows that motion and ultimately is placed in a fully opened position as it continues to travel through the opening assembly on the transport conveyor. The same type of apparatus applies the same manipulation to the lower basket side wall.

In this type of opening assembly, however, there exists a speed differential due to the basket's traveling on its side in a horizontal motion or direction along the machine's longitudinal path by the transport conveyor at a fixed velocity, and the vacuum cup's moving in a circular motion, the horizontal component of which constantly changes. In this type of device, it is intended that these components, that is the conveyed carton and the opening assembly, will be at a matching speed at the moment of contact. Even if all conditions are ideal and such speed matching is accomplished, however, the vacuum cups will strike the carton side wall at an angle less than 90° rather than perpendicular, which results in vacuum cup wear. A second factor associated with the Rough Rider 2000™-type opening assembly, which results from the change of speed of the horizontal component of the carton side wall as it moves through the assembly in a progressively opened configuration, is that the carton tends to be opened abruptly, imparting a shock to the carton at its maximum opened position. This abrupt opening, however, is considered suitable for the Rough Rider 2000™-type carton, considering that it includes a relatively stable, pre-glued base. In the Rough Rider 2000™ packaging machine, the maximum opening time achievable, which is a theoretical maximum, is a quarter of a cycle of the rotating pivots from the point the vacuum cups engage the carton to the point where the carton is fully opened. Typically, however, the opening time would be less than a quarter of the cycle in practical applications, as the horizontal velocity component is zero at 90°.

A second type of basket packaging machine processes baskets without a pre-formed base or bottom wall. An example of this type of machine is Riverwood International Corporation's Autoflex 2000™ machine. This type of packaging machine is a basket-type machine in which the fully opened basket is lowered over the pre-configured bottle group at the article packaging workstation. That is, in this system, rather than dropping the product into the preformed basket, the product proceeds through the machine in a straight line, and the open-base basket is lowered over the product, with its bottom flaps thereafter glued underneath.

The Autoflex 2000™ packaging machine also includes opposed vacuum plate, walking beam-type opening mechanisms, which results in the same factors as the Rough Rider 2000™ opening assembly. The Autoflex 2000™ packaging machine also includes servo motors to actuate the opening mechanism so that the opening cycle is more efficiently timed with the progression of the collapsed carton through the opening assembly, thus improving the performance of earlier systems.

Known basket opening mechanisms, such as those described above, however, while efficient in many respects and applications, still are limited in some respects due to the characteristics of the vacuum plate motion in the opening cycle. There is a need in the art, therefore, for a basket-type carton opening mechanism which can accomplish more controlled basket opening over a longer period of time through a longer transport distance, and that also contacts the basket side walls perpendicularly and tracks the carton through the machine as the carton is opened. The invention of the present application presents a novel method and apparatus to overcome many of the disadvantages of prior art basket opening assemblies, and accomplishes these desired results.

SUMMARY OF THE INVENTION

The present invention is a carton opening assembly and method for opening partially formed, collapsed paperboard cartons, such as those cartons used in the beverage container packaging industry. While the method and apparatus disclosed and claimed can be used to open paperboard cartons, the present invention is not limited to opening cartons, but could be utilized to open any article from a collapsed condition having a side wall which can be engaged by opposed contact members, such as vacuum cups. The present invention, however, is illustrated as opening beverage cartons, and more specifically, basket-type cartons. The opening assembly comprises pairs of opposed carton engaging assemblies adapted to engage the opposed side walls of a collapsed paperboard carton. The engaging assemblies disclosed utilize vacuum cups, although other types of engaging members, including those providing for mechanical engagement, could be utilized. The opening assembly is designed to open cartons in a continuous fashion being fed to the opening assembly by a conveyor. This assembly is ideal for use in packaging machines, including but not limited to those which open a basket for later placement onto a bottle group.

The carton engaging assemblies are driven in continuous fashion about head and tail sprockets in timed relationship with cartons passing through the opening assembly, so that each carton engaging device will contact a carton and place it at either a fully or partially opened position before the engaging assemblies pass through a return path to repeat the opening method or operation. The opening assemblies can be utilized to place the carton either into a partially opened or a fully opened position, depending upon the desired state of opening of the carton at the downstream workstation.

The opening assembly is designed so that elements of the carton engaging assemblies are moved toward the collapsed carton side walls in a direction perpendicular to the carton side walls and perpendicular to the path of travel of the carton through the opening assembly. This motion of the carton engaging assemblies occurs while the carton engaging assemblies are moving along the path of travel in the direction of carton feed. In this manner, the carton engaging assemblies track the motion of, or move in timed relationship with the carton through the opening assembly as elements of the carton engaging assemblies engage and pull one or more of the carton side walls outwardly to either partially or fully open the carton.

DETAILED DESCRIPTION OF THE PREFERRED EMBODIMENTS

Figure 1:
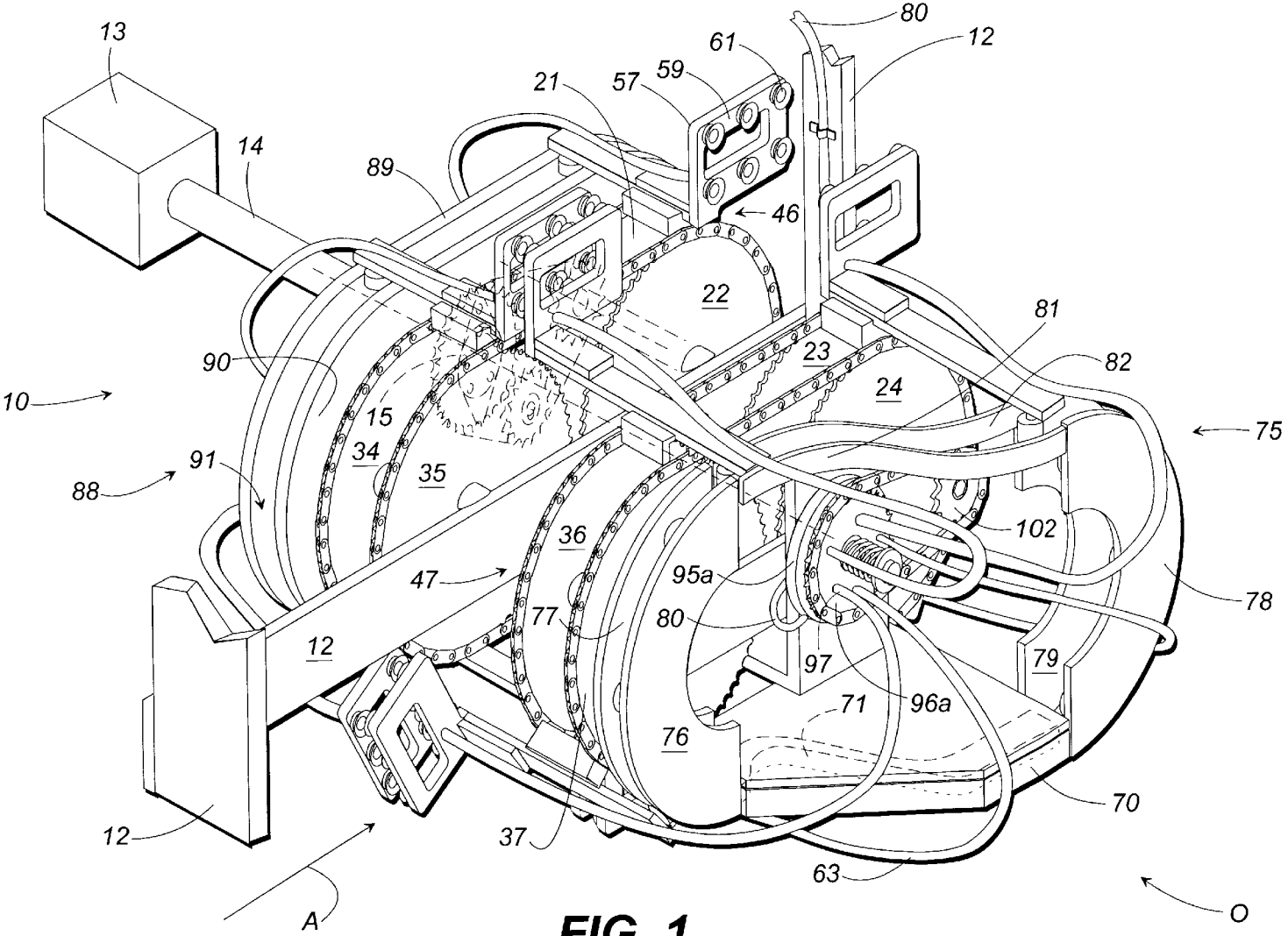
FIG. 1 is a perspective view of one embodiment of the opening assembly of the present invention.

FIG. 1 depicts one embodiment of the carton opening assembly 10 of the present invention. Opening assembly 10 primarily is intended to open partially formed, collapsed basket-type cartons for article carriers. For purposes of description of the present invention, the terms cartons, carriers, or baskets are used interchangeably to describe a basket-type paperboard carton. This invention, however, including the method and apparatus described and claimed, is not intended to be limited to an opening assembly or apparatus and method for use only in opening paperboard cartons. The present invention could be utilized to manipulate any suitable object, as described herein.

Figure 2:
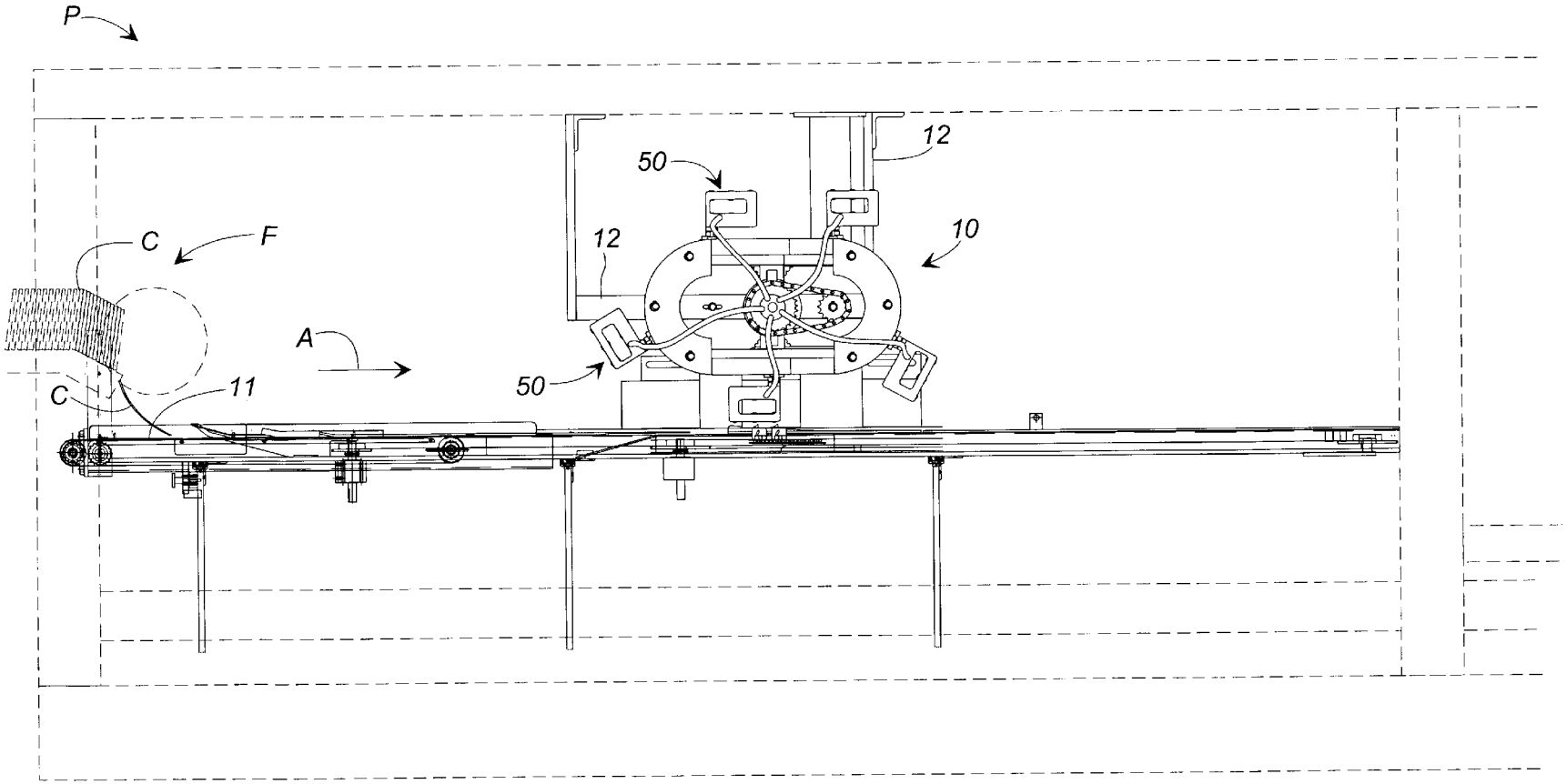
FIG. 2 is a schematic, side elevational view of part of an article packaging machine showing placement of the embodiment of FIG. 1.
Figure 8:
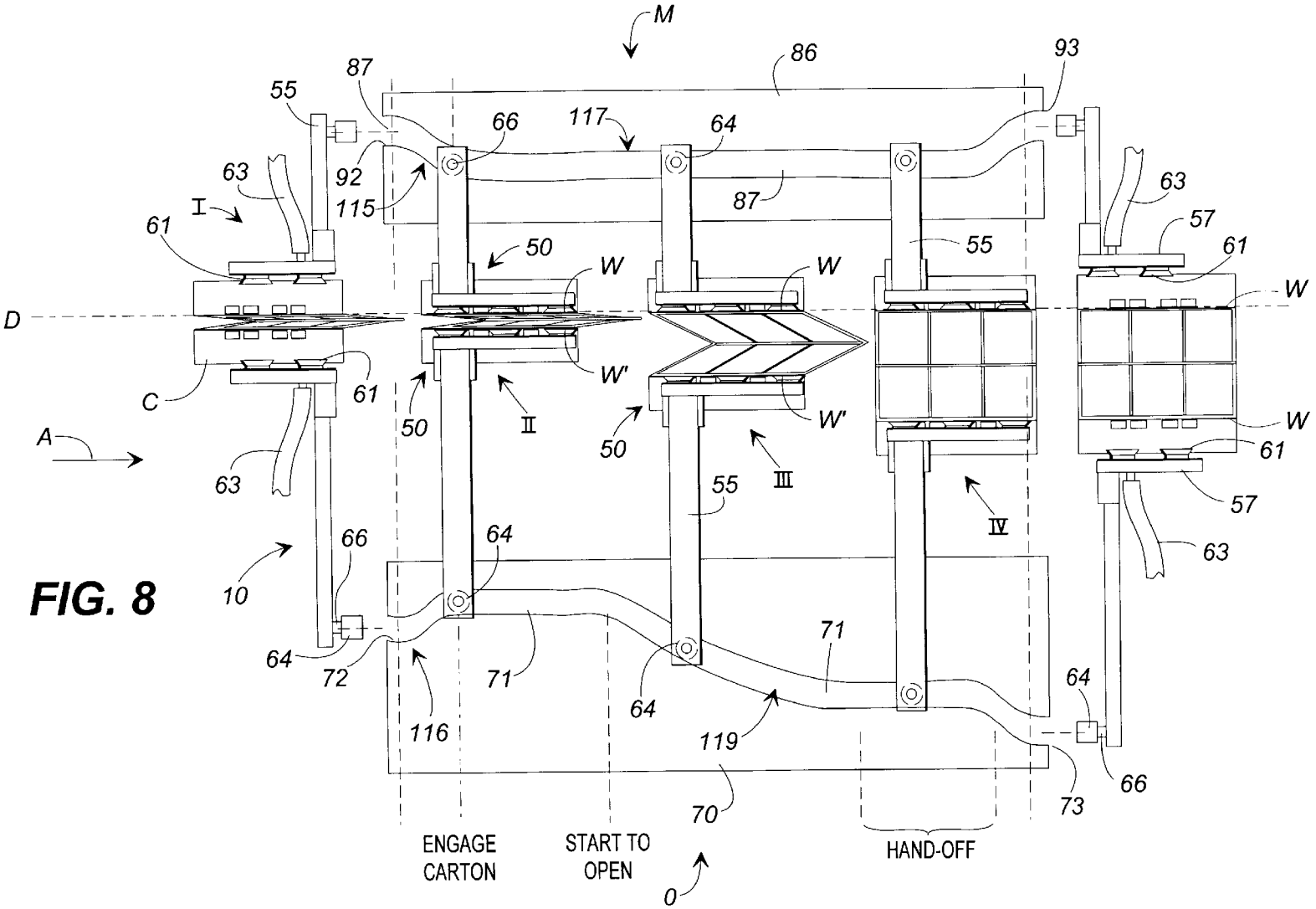
FIG. 8 is a schematic representation of the opening sequence of the embodiment of FIG. 1.

FIG. 2 depicts the orientation and placement of opening assembly 10 in a continuous motion article packaging machine P, while illustrating only the first two workstations of packaging machine P. These include carton feeder F, which is the most upstream workstation, and opening assembly 10. A transport mechanism, such as chain conveyor assembly 11 receives a carton C from carton feeder F, and transports carton C downstream in the direction of arrow A (feed direction) to opening assembly 10. FIG. 2 depicts numerous cartons C, which are collapsed and arrayed in a magazine arrangement in feeder F. The carton feeder F can be any one of numerous, well-known carton feeders capable of delivering a collapsed basket-type carton from a supply magazine to a transport mechanism. Similarly, the transport mechanism can be one of any well-known transport mechanisms such as belt conveyors or chain conveyors having upstanding lugs, such as those conveyors used on prior packaging machines, including the machines discussed above. Some known systems utilize more than one conveying system, such as a conveyor belt to transport the carton from feeder F to a chain conveyor which moves the carton to the opening assembly. The present invention is not limited to any conveying system or type of conveyor. Various known systems capable of delivering the correctly oriented carton to opening assembly 10 are acceptable. Such feeders and transport assemblies are well-known and are not further described. The embodiment of the opening assembly 10 illustrating the present invention, however, contemplates that the collapsed basket entering the opening assembly 10 will be oriented with its handle extending vertically upward and its bottom wall flaps, which are attached to opposed side walls, arranged outwardly, such as in a substantially horizontal orientation. The collapsed carton or basket entering the opening assembly 10 is oriented in an arrow orientation with the leading edge pointing downstream, as shown in FIG. 8. It is also well-known in the art of carton transport or conveying assemblies to provide carton orienting devices such as camming plates, which properly orient the basket and its bottom wall flaps as it is moved toward the opening assembly. Therefore, such orienting devices, being well-known and part of known article transport assemblies, are not further described.

For purposes of illustrating the present invention, however, a chain conveyor assembly 11 is illustrated, however, a known belt-type system or combination of belt and chain systems also could be used. Conveyor assembly 11 receives a collapsed carton C from feeder F, and moves the carton into contact with cam plates (not shown) which orient the carton with its handle extending vertically and aligned with conveyor 11 front to rear with bottom wall flaps extending outwardly and leading point or edge facing downstream. Conveyor assembly 11 then moves carton C downstream to opening assembly 10. As will be further described, the chain conveyor assembly used for illustrating the present invention includes lugs which engage openings in the bottom wall flaps of the carton C to move the carton in the downstream direction depicted by arrow A.

Referring again to FIG. 1, opening assembly 10 includes a support frame 12, which is centrally disposed with respect to the moving elements of opening assembly 10 so as not to interfere with such movement. Frame 12 supports, directly or indirectly, the remaining elements of opening assembly 10. A drive mechanism 13 imparts force to the driven components in order to accomplish the component movement and opening methods described. Drive mechanism 13 can be a motor, such as an AC or servo motor, directly driving output shaft 14. Alternatively, drive mechanism 13 can be a bevel gear box translating the direction of rotation of an input shaft (not shown) extending from one of the packaging machine's main drive mechanisms (not shown). Output shaft 14 is fixed at its opposite end to main drive sprocket 15, shown in phantom lines in FIG. 1 and also shown in FIG. 3.

Figure 3:
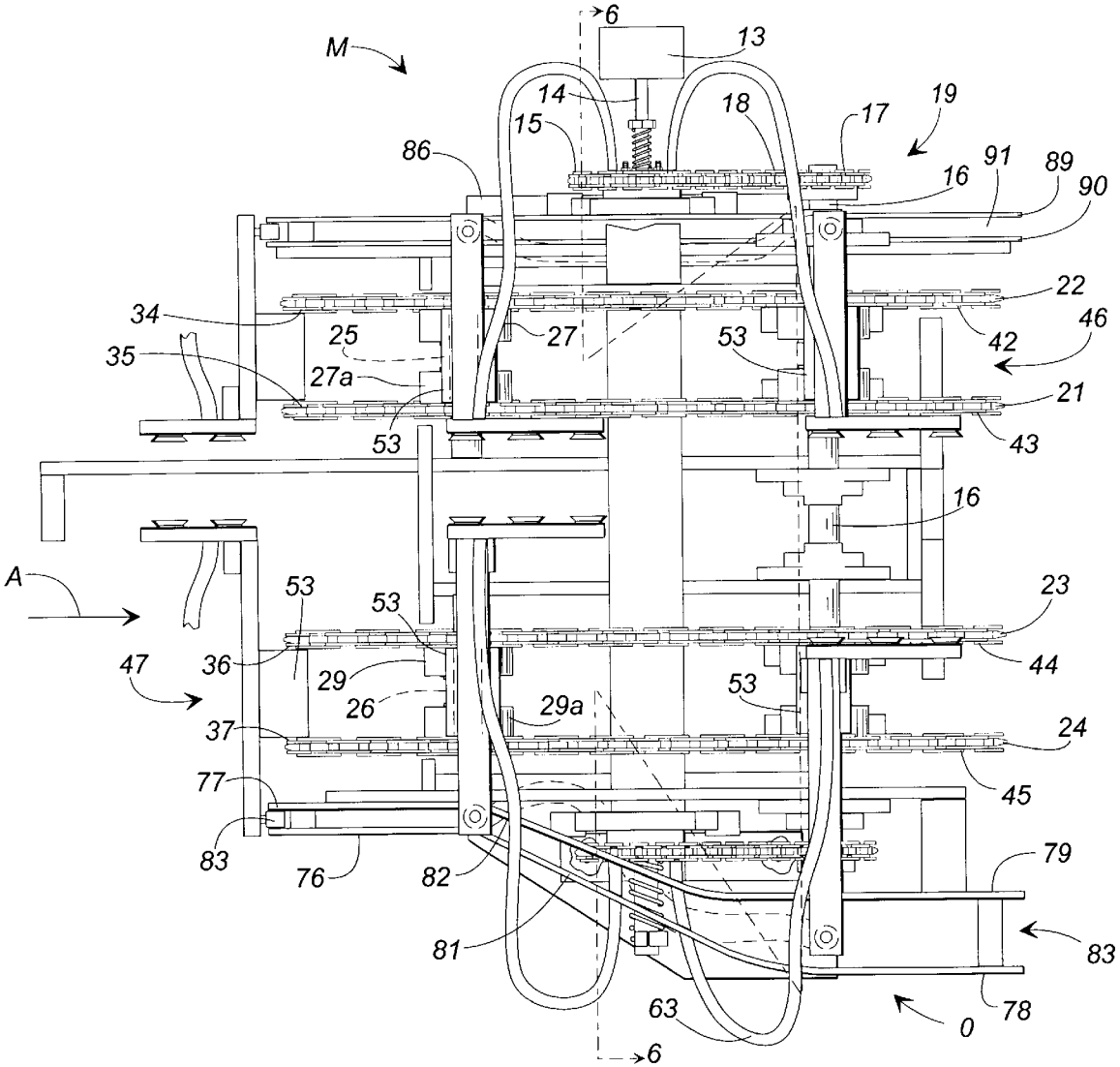
FIG. 3 is a plan view of the embodiment of FIG. 1.

Head drive shaft 16 is journaled by bearings (not shown) which are supported by frame 12 so that head drive shaft 16 is positioned parallel to output shaft 14 and spaced downstream of shaft 14, as shown in FIG. 3. Drive shaft 16 supports at one end portion, head drive shaft sprocket 17. A drive chain 18 passes around main drive sprocket 15 and head drive shaft sprocket 17 to transfer rotation from output shaft 14 to head drive shaft 16. Drive mechanism 13, output shaft 14, drive sprockets 15 and 16 and chain 18 collectively comprise a drive assembly 19 for the moving components of the opening assembly 10. Drive assembly 19 illustrated and described, however, is only one embodiment of a suitable drive assembly of the present invention. Any drive mechanism capable of rotating head shaft 16 at desired power and rate would be acceptable. For example, main drive sprocket 15 and head drive shaft sprocket 17 may be interconnected by additional gears (not shown) rather than by chain 18. This gear arrangement could be advantageous in preventing undesirable reversal or backlash of drive mechanism 19, which could occur when a drive chain is utilized to transfer power from drive sprocket 15 to driven sprocket 17.

Two pairs of head sprockets are fixed to drive shaft 16. Head sprockets 21 and 22 are arranged as one spaced sprocket pair, and head sprockets 23 and 24 are a second spaced sprocket pair. All head sprockets are fixed or keyed to drive shaft 16 to turn or rotate along with shaft 16. As shown in FIG. 3, drive shaft 16 extends horizontally through opening assembly 10, perpendicular to the direction of feed indicated by arrow A from the "maintenance" side M of assembly 10 and terminating just inwardly of the "operator" side O of assembly 10. This arrangement allows all head sprockets to be driven from a single shaft.

Opening assembly 10 also includes two pairs of tail sprockets, each pair of which operatively coincides with a respective pair of head sprockets. Each separate pair of tail sprockets are supported by separate tail shafts. Tail shaft 25 comprises a stub shaft which is fixed to and supported by frame 12, and is spaced in the upstream direction from head drive shaft 16 and parallel to shafts 14 and 16. Preferably, the longitudinal axis of tail shaft 25 is offset from the longitudinal axis of drive shaft 14 the same distance as the offset distance of drive shaft 16 from shaft 14. This spacing, however, is not critical to the operation of the present invention. A second tail shaft 26 is supported by frame 12. As seen in FIG. 3, shaft 26 is spaced from shaft 25 toward the operator side 0 of opening assembly 10, with the longitudinal axis of shaft 26 being in alignment with the longitudinal axis of shaft 25. Shafts 25 and 26 are identical in structure and function, and are static shafts that function as supports, and are movable in the direction of conveyor 11 which allows for chain tensioning, but themselves do not rotate. Tail shaft 25 supports spaced bearings inside the hubs of tail sprockets 34 and 35. Similarly, shaft 26 supports spaced bearings (not shown) inside the hubs of tail sprockets 36 and 37. FIG. 3 shows sprocket 34 with hub 27, sprocket 35 with hub 27*a*, sprocket 36 with hub 29 and sprocket 37 with hub 29*a*. Sprockets 34 and 35 form a pair of sprockets that are in alignment in the direction of feed, arrow A, with head sprocket pair 21 and 22. Referring to FIG. 3, tail sprocket 34 is aligned with head sprocket 21, and tail sprocket 35 is aligned with head sprocket 22. Tail sprocket 36 is attached to hub 29 and tail sprocket 37 is attached to hub 29*a*, forming a second pair of tail sprockets. Tail sprocket 36 is aligned with head sprocket 23 and tail sprocket 37 is aligned with head sprocket 24 in the direction of feed, A. Tail sprockets 34, 35, 36 and 37 are considered idler sprockets which rotate freely about their respective support shafts 25 and 26. Preferably, all four head sprockets and all four tail sprockets are structurally identical, that is in size, shape and number of teeth.

A drive chain 42 passes around head sprocket 21 and tail sprocket 34; a drive chain 43 passes around head sprocket 22 and tail sprocket 35; a drive chain 44 passes around head sprocket 23 and tail sprocket 36; and a drive chain 45 passes around head sprocket 24 and tail sprocket 37. Since all head sprockets are keyed to drive shaft 16, the rotation of drive shaft 16 will cause the identical rotation of tail sprockets 34, 35, 36 and 37. Since head sprockets 21 and 22 drive tail sprockets 34 and 35 through respective drive chains 42 and 43, these elements constitute collectively a carton opener drive assembly 46. Similarly, head sprockets 23 and 24 which drive tail sprockets 36 and 37 through chains 44 and 45, respectively, constitute a second carton opener drive assembly 47.

Figure 4:
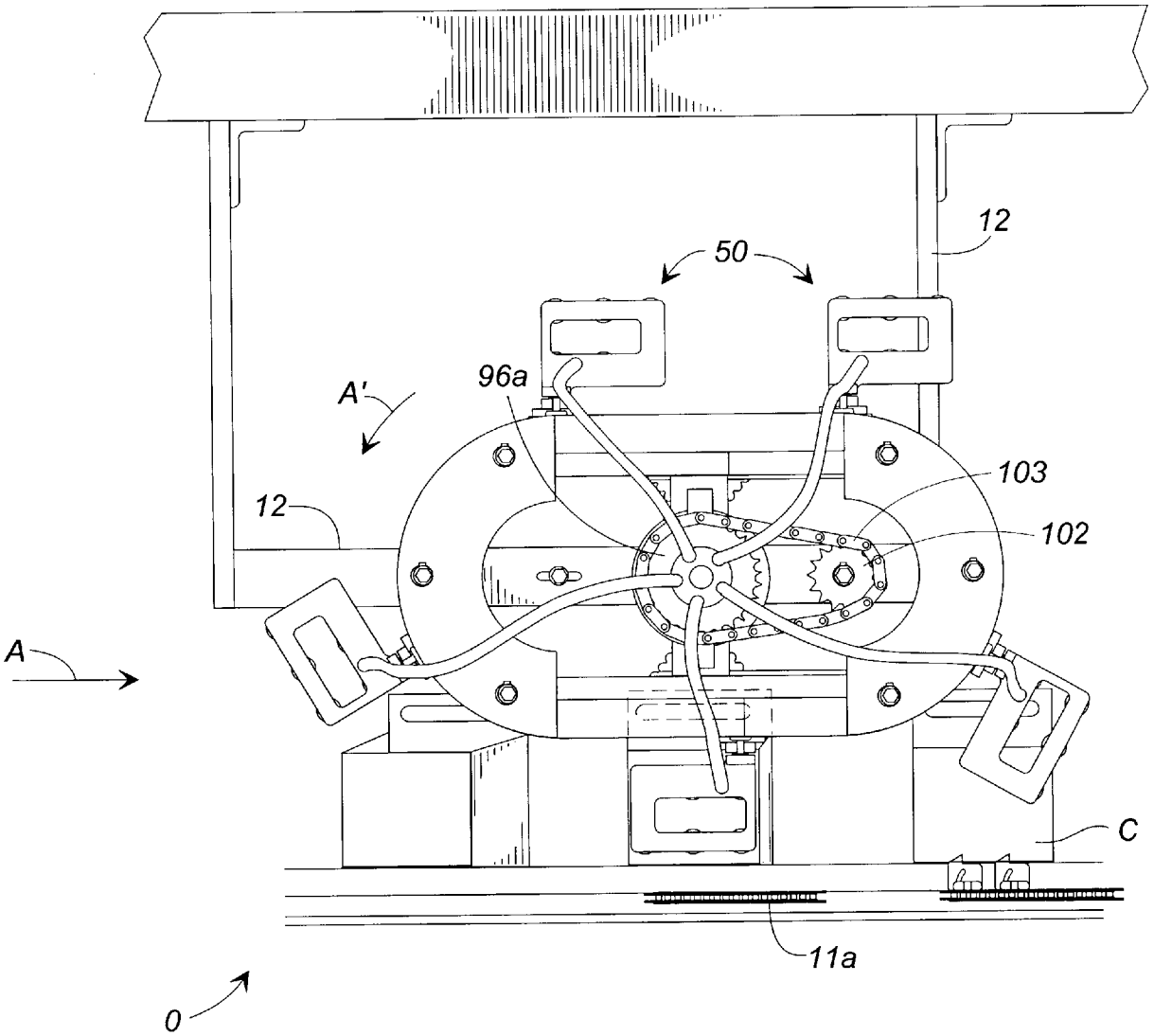
FIG. 4 is a side elevational view of the embodiment of FIG. 1.
Figure 5:
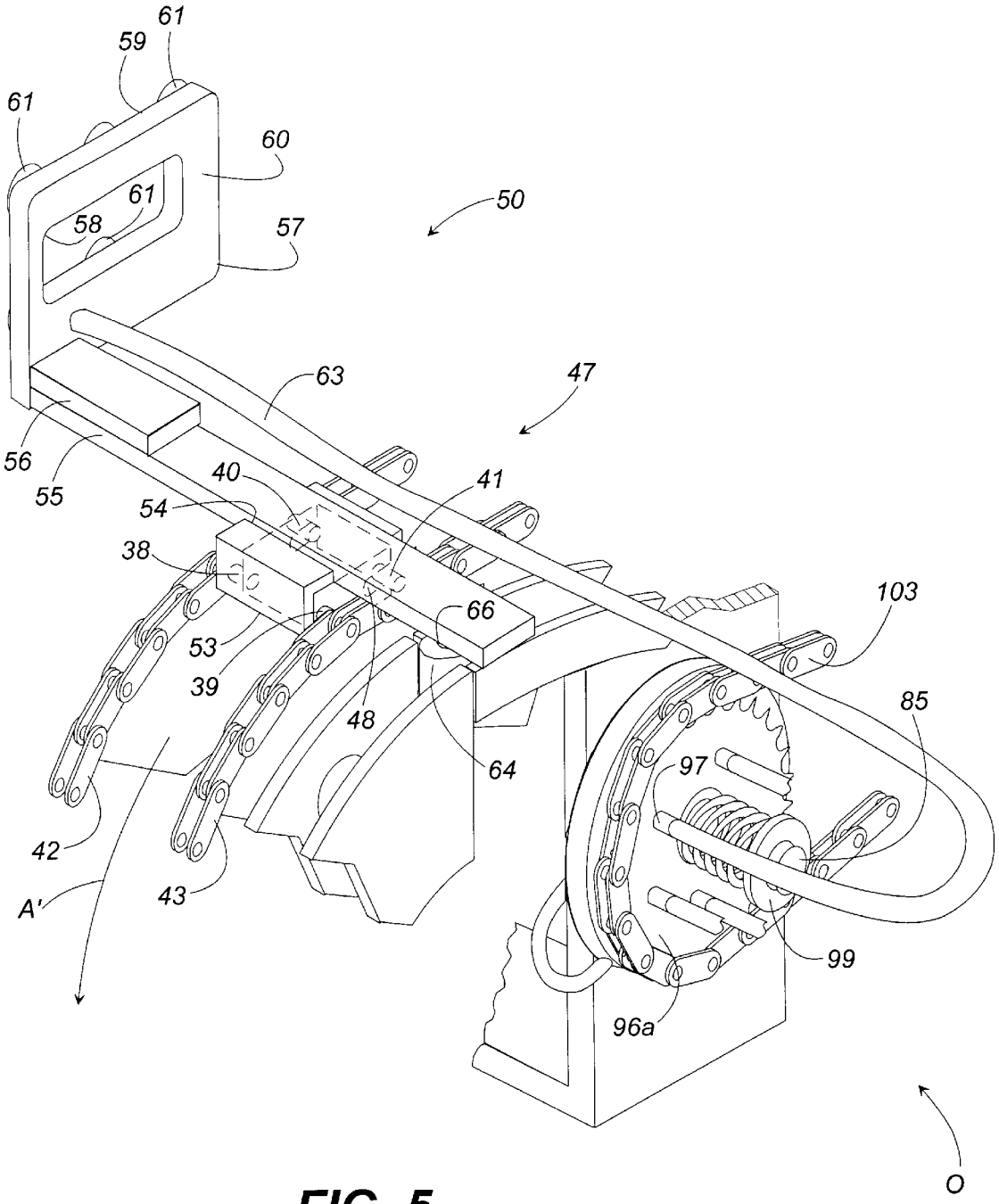
FIG. 5 is a perspective, fragmented view of one carton engaging assembly of the present invention.

Each carton opener drive assembly drives one or more carton engaging assemblies 50. For the purposes of describing one embodiment of the present invention, each carton opener drive assembly 46 and 47 drives five carton engaging assemblies 50 as shown in FIG. 4. The carton engaging assemblies 50 (FIG. 5) are identical in structure, and include a support block 53 which is attached at either end by any suitable mounting means well known in the art to both drive chains of a carton opener drive assembly. The present invention utilizes four pins which are attached to the pairs of drive chains and received within each support block to fix the support block between the two drive chains of a carton opener drive assembly. For example, FIG. 5 shows a partial view of carton opener drive assembly 47 and a carton engaging assembly 50. The attachment pins include leading support pin 38 affixed at one end to drive chain 42 with its other or free end extending toward drive chain 43. A second leading support pin 39 is affixed to the drive chain 43 and extends toward pin 38 and in axial alignment with pin 38. Since the movement of the drive chain is in the counterclockwise direction when viewing opening assembly 10 from the operator side O, support pins 38 and 39 are considered leading support pins. The leading support pins are received in corresponding openings (not shown) defined in the leading end portion of support block 53, so that support block 53 can rotate about pins 38 and 39, respectively. Trailing support pins 40 and 41 support the trailing end portion of support block 53. Support pin 40 is attached to drive chain 42, and support pin 41 is attached to drive chain 43. Similarly, trailing support pins 40 and 41 are in axial alignment. Support pins 40 and 41 could comprise one pin extending from chain 42 to chain 43. Support pins 41 and 42 are received within an open channel or open notch or slot 48 defined in the trailing end portion of support block 53. This arrangement allows trailing support pins 40 and 41 to support block 53, including as block 53 rotates in an arcuate path around the head sprockets 21 and 22 and the tail sprockets 34 and 35 while permitting limited movement of block 53 on pins 40 and 41. All support blocks 53 of the present invention are supported on the drive chains in this manner. Therefore, support block 53 is attached at its leading end to chains 42 and 43 and at its trailing end to chains 42 and 43 in a fixed manner, but also so as to be moved along with chain 42 and 43 as they are driven in unison around their associated head sprockets and tail sprockets.

Support block 53 defines a longitudinal channel 54 within its upper side and along its longitudinal axis, which extends from one chain of its associated drive assembly to the other chain of the drive assembly as shown in FIG. 5. Support block 53 comprises and functions as a linear slide bearing, and can be manufactured of delrin or other suitable material to reduce the friction of elements sliding within channel 54. Carton engaging assembly 50 also includes a slide bar 55 which is received within channel 54 of support block 53. Slide bar 55 is intended to slide within channel 54 in a reciprocating motion perpendicular to the direction of feed A, that is toward and away from the maintenance side M and operator side 0 of opening assembly 10, respectively, above and without contacting drive chains 42 and 43. Support block 53 can include a flange or lip (not shown) or other means to contain slide bar 55 within channel 54, while permitting the reciprocating movement of slide bar 55. Channel 54 also can be milled through support block 53, which would then define a tubular channel rather than an open channel. It is only necessary that support block 53 be fixed to its associated chains of a carton opener drive assembly while allowing limited rotation for travel in an arcuate path, and support a slide bar for transverse reciprocating movement. A bracket or other mount such as bracket 56 is attached to the inner end of slide bar 55. Attached to the bracket 56 and to slide bar 55 is a vacuum plate 57. Alternatively, vacuum plate 57 and bracket 56 could be made as a unitary element. The vacuum plate 57 is shown for the purposes of illustration as a rectangular plate defining an opening 58, which is defined in plate 57 to reduce its mass. Plate 57 includes an interior side wall 59 which defines a series of ports or openings (not shown). Attached to each port is a vacuum cup or suction cup 61. For the purposes of illustrating the present invention, FIG. 1 depicts the vacuum plate 57 having six suction cups 61, although the number of vacuum ports (not shown) and associated suction or vacuum cups 61 can vary depending upon the type and design of carton or basket being opened. The opposite or outer side wall 60 of vacuum plate 57 defines an outlet port (not shown) and interior channels (not shown) within plate 57. These interior channels connect all inlet ports defined in side wall 59 to the outlet port defined in side wall 60. A vacuum hose 63 is attached by any suitable means to the single outlet port (not shown) defined in outer side wall 60 ultimately to a main vacuum delivery system, which will be described in further detail. Therefore, as a vacuum is drawn through hose 63 to the outlet port in side wall 60, the vacuum also is drawn through the inlet ports (not shown) defined in side wall 59 and through vacuum cups 61. At the opposite or outer end of slide bar 55 is a cam follower 64. Cam follower 64 is attached to the bottom side of slide bar 55 by, for example, downwardly extending rod or shaft 66 (FIG. 8), so that cam follower 64 can freely rotate about shaft 66.

Thus, the rotation of the head sprockets 23 and 24 in a counterclockwise direction as seen in FIGS. 4 and 5 in the direction of arrow A' likewise moves their associated chains 42 and 43 in the direction of arrow A'. Support block or linear slide bearing 53 moves in conjunction with the matched motion of chains 42 and 43 to move carton engaging assembly 50 in the direction of arrow A'. The slide bar 55 and associated vacuum plate 57 also are moved in the direction of arrow A'. Additionally, since slide bar 55 is slidably received within channel 54 of support block 53, slide bar 55 and its associated vacuum plate 57 also can reciprocate inwardly and outwardly or toward and away from the maintenance side M and the operator side O, respectively. The carton engaging assemblies 50 of the present invention are identical in structure with the exception of the length of slide bars 55 in the first embodiment of the present invention. As seen in FIG. 8, the slide bars 55 of carton engaging assembly 50 associated with drive assembly 47 are longer than slide bars 55 of carton engaging assembly 50 associated with drive assembly 46. Also, the stroke of the slide bars would be longer for the longer slide bars 55 associated with drive assembly 47. The actuation of the assemblies 50 associated with each separate pair of head shaft and tail shaft groups, however, can differ depending upon the embodiment of the present invention. FIG. 1 depicts an embodiment of the present invention in which the actuation of the reciprocal movement of the carton engaging assemblies 50 differs depending upon whether an assembly 50 is associated with carton opening drive assembly 46 or with carton opening drive assembly 47, respectively.

In the embodiment illustrated in FIG. 1, the reciprocating actuation mechanism for carton engaging assemblies 50 associated with carton opener drive assembly 47 first will be described. This carton opener drive assembly 47 is positioned at the operator side O of opening assembly 10. The actuation of slide bar 55 and their associated components attached to drive assembly 47 is accomplished by the movement of cam followers 64 within cam tracks defined by upper and lower cams. Lower cam 70 is positioned adjacent operator side O below drive assembly 47. Lower cam 70 defines cam track 71 as shown in FIGS. 1 and 8. FIG. 8 schematically depicts part of opening assembly 10, showing a plan view of lower cam 70 and three carton engaging assemblies 50 being guided by lower cam 70. The rotational movement of carton engaging assemblies 50, following the path of chains 44 and 45 around their associated head sprockets 23 and 24 and tail sprockets 36 and 37, moves cam 64 of engaging assembly 50 into cam track 71. Continued movement of drive assembly 47 in the direction of arrow A' forces a cam follower 64 of a carton engaging assembly 50 to move in the direction of arrow A through cam 70 along cam track 71 from left to right as illustrated in FIG. 8. This causes the inward and outward reciprocation of slide bar 55, which moves or reciprocates its associated components inwardly and outwardly toward and away from maintenance side M and operator side O, respectively. Cam 70 is considered a changeable part, that is, it can be removed from its position and replaced with another lower cam which defines a different cam track. The elements for releasably attaching the lower cam in place are variable and could include threaded pins or bolts, and are within the knowledge of those skilled in the art and not further described. Each lower cam track 71 includes an entry position 72 and an exit position 73.

Positioned above lower cam 70 is upper cam 75. Upper cam 75 is comprised of spaced, curved plates 76 and 77, which are positioned at the upstream end of lower cam 70 adjacent entry position 72, and spaced, curved plates 78 and 79, which are positioned at the downstream end of lower cam 70 adjacent exit position 73. The upper end of plate 76 is connected to the upper end of plate 78 by curved bar 81, while the upper end of plate 77 is connected to the upper end of plate 79 by curved bar 82. Thus, as shown in FIGS. 1 and 3, the cooperation of plates 76, 77, 78, 79, 81 and 82 comprise upper cam 75 defining upper or return cam track 83 between these opposed, spaced plates. Therefore a cam follower 64 can be caused to travel smoothly through lower cam track 71 of lower cam 70 and into upper cam track 83 and back into lower cam track 71 in a continuous fashion as carton opener drive assembly 47 is rotated in the direction of arrow A'. As shown in FIGS. 1 and 3, the spacing between plates 78 and 79 of upper cam 75 is further apart than the spacing of plates 76 and 77. Curved bars 81 and 82, however, allow smooth transition between more widely spaced plates 78 and 79 and more narrowly spaced plates 76 and 77. The spacing of the plates of upper cam 75 in this matter allows for the accommodation of different lower cams having different cam tracks with common entry positions and different exit positions from that illustrated in FIG. 1. Therefore, a lower cam 70 can be changed to accommodate the opening of a different sized carton or basket without the necessity of having to change the upper cam 75. This feature compliments the versatility and quick changeover of the present invention to open cartons desired to accommodate bottles of different diameters, with a minimum of labor and parts required to effect such changeover.

The actuation of the carton engaging assemblies 50 associated with carton opener drive assembly 46 is similar, although the path of the associated lower and upper cam tracks differ from the path of tracks 71 and 83. As shown in FIG. 8, the maintenance side M of assembly 10 includes a second lower cam 86 defining lower cam track 87, the profile of which differs from lower cam track 71. Lower cam 86 is intended to be a permanent, non-change part in the first embodiment chosen for illustrating the present invention. As will be further discussed, however, in other embodiments lower cam 86 could be a change part which may include a cam track which is the mirror image of cam track 71. The maintenance side M of assembly 10 also includes upper cam 88 (FIG. 1) which comprises spaced plates 89 and 90 that define upper cam track 91. Cam track 91 cooperates with the entry position 92 of cam track 87, and the exit position 93 of cam track 87 so that cam follower 64 of carton engaging assembly 50 being driven around carton opener drive assembly 46 smoothly transitions between upper cam track 91 and lower cam track 87.

Figure 6:
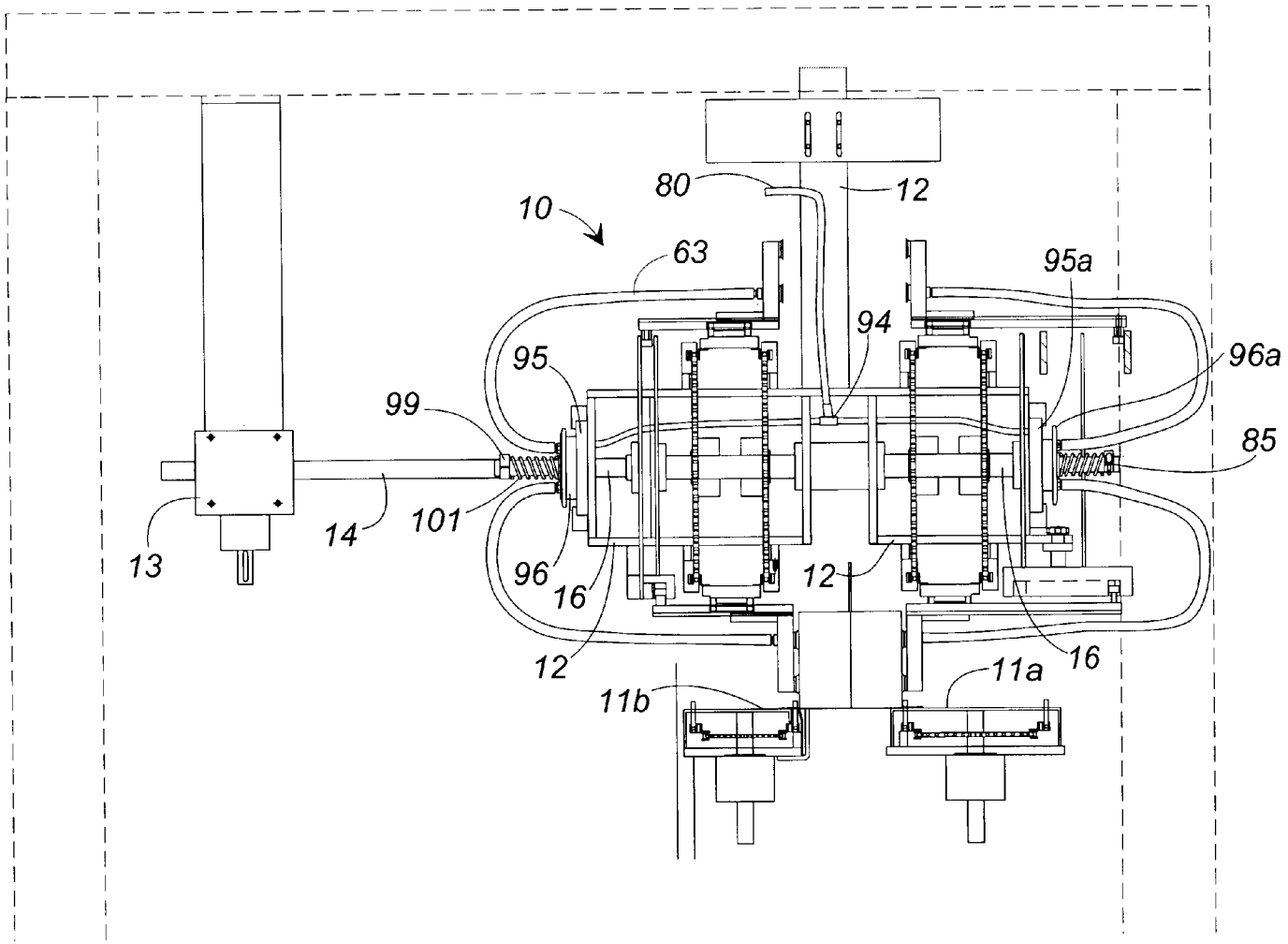
FIG. 6 is a partial, cross-sectional elevational view of the head shaft and related components of the embodiment of FIG. 1, taken along lines 6—6 of FIG. 3.

Vacuum is applied to all carton engaging assemblies through a main vacuum supply (not shown) by way of a main vacuum line 80 which is divided through splitter or divider 94 (FIG. 6) to vacuum valves 95 and 95*a*. Vacuum valves 95 and 95*a* are identical, and are static elements fixed to frame 12. Each vacuum valve 95 and 95*a* defines an arcuate internal channel or chamber (not shown) which communicates with the main vacuum supply line 80. The size and shape of the chamber is dependent upon the timing of the vacuum to be applied to each carton engaging assembly. Valve 95 is positioned adjacent the maintenance side M, and valve 95*a* being positioned adjacent operator side O. A sprocket or vacuum distribution plate 96 is positioned to abut and to slidably engage vacuum valve 95. Similarly a sprocket or vacuum distribution plate 96*a* is positioned to abut and slidably engage vacuum valve 95*a*. Vacuum distribution sprocket 96 is mounted to guide shaft 14 so as to turn along with output drive shaft 14. Vacuum distribution sprocket 96*a*, however, turns about shaft 85 which extends through sprocket 96*a* and is mounted to frame 12. The outer side wall or surface of each vacuum distribution sprocket or plate defines vacuum supply ports (not shown) which are identical in number to the number of carton engaging assemblies 50 associated with each respective carton opening drive assembly 46 and 47. The vacuum distribution sprockets 96 and 96*a* preferably include fixed inlet tubes 97 associated with each vacuum supply port (not shown) for ease of attachment of a vacuum supply line 63 to each inlet tube 97 and then to vacuum plate 57.

Since the structure and function of valves 95 and 95*a* and distribution sprockets 96 and 96*a* are identical, description will be made only with reference to elements 95 and 96. A vacuum line 63 comprised of a flexible tube connects each inlet tube 97 to the vacuum port (not shown) on the outer sides of each vacuum plate 57. A collar 99 engages shaft 14 and is adjustable toward and away from distribution plate 96. A tension element or spring 101 surrounds shaft 14 between collar 99 and vacuum distribution plate 96 to urge vacuum distribution plate 96 against vacuum valve 95. This type of turning vacuum manifold or rotating vacuum distribution sprocket mechanism with a vacuum distribution disc or valve is well-known in the art, especially with regard to rotary carton feeders used in continuous motion packaging machines of the type described above and used in association with opening assembly 10.

On the operator side O of opening assembly 10, a sprocket 102 is fixed to the end of head drive shaft 16. Chain 103 (FIG. 5) extends around sprocket 96*a* on the operator's side O of opening assembly 10 and around sprocket 102. As drive shaft 16 rotates, sprocket 102 is similarly rotated in the direction of arrow A' (FIG. 4) which causes vacuum distribution sprocket 96*a* to rotate in timed relationship with the movement of each associated carton engaging assembly 46 and 47. As illustrated in FIG. 1, this vacuum valve and vacuum distribution line arrangement allows the carton engaging assemblies 50 to be rotated around head sprockets 23 and 24 and tail sprockets 36 and 37 without causing vacuum lines 63 to become entangled with any stationary elements. Therefore vacuum lines 63 are swept around the drive sprockets and cams of the opening assembly 10 without interference with any moving or fixed elements.

Similarly, distribution sprocket 96 turns in the direction of arrow A' by the rotation of shaft 14 in conjunction with carton engaging assemblies 50, which are mounted to carton opening drive assembly 46. The vacuum valve and vacuum distribution sprocket arrangement on the maintenance side M of opening assembly 10 also accomplishes the rotational movement of associated vacuum lines 63 around output shaft 14 without interference between vacuum lines 63 and other elements of opening assembly 10. The internal frame arrangement illustrated and described is designed to support the elements of opening assembly 10 without interfering with the movement of any elements.

Figure 7:
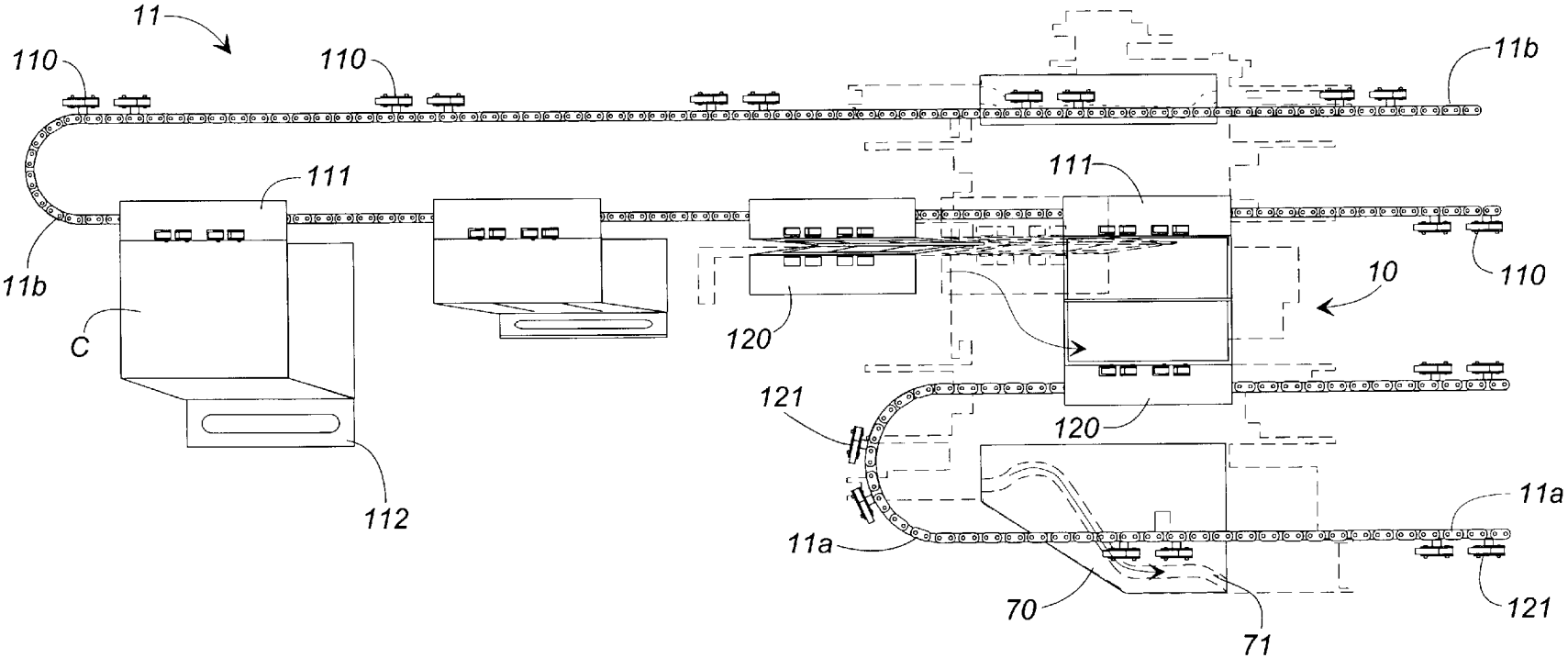
FIG. 7 is a schematic, plan view of the carton transport conveyors of an article packaging machine, showing the embodiment of FIG. 1 in phantom lines.

In operation, feeder F delivers cartons C to conveyor assembly 11. As is well-known in the art, the movement of feeder F and conveyor 11 are synchronized so that single cartons are continuously fed through the packaging machine P. FIG. 7 schematically depicts cartons which have been fed from feeder F to conveyor 11. In FIG. 7, conveyor section 11*b* having spaced pairs of lugs 110 engage a carton bottom flap 111. Carton C is moved towards opening assembly 10 by conveyor 11*b*. As is well-known in the art, cams or plow assemblies (not shown) orient carton C so that handle 112 extends upwardly in a vertical position as carton C enters opening assembly 10. FIG. 8 schematically shows the stages of sequential operation of opening assembly 10 on five separate cartons C. In FIG. 8 a properly oriented carton C is shown in position I entering assembly 10. At this position, the suction cups 61 of opposed carton engaging assemblies 50 have not yet come in contact with the side walls of carton C. From position I shown in FIG. 8, carton engaging assembly 50, which is driven by carton opener drive assembly 46, is rotated around tail sprockets 34 and 35 so that their associated cam followers 64 are received in the entry position 92 of cam track 87. Similarly, a carton engaging assembly 50 driven by carton opener drive assembly 47 is driven so that its cam followers 64 enter cam track 71 at entry position 72. In all instances a carton engaging assembly 50 associated with a carton opener drive assembly 47 directly opposes an identical carton engaging assembly 50 associated with carton opener drive assembly 46. FIG. 8 also depicts opposed carton engaging assemblies 50 in position II. In this position, the opposed engaging assemblies 50 have passed through the initial portion 115 of cam track 87 and the initial portion 116 of cam track 71. The plates 57 of opposed carton engaging assemblies 50 are being moved or directed in a path perpendicular to the orientation of the carton side walls W and W' until their associated vacuum cups 61 engage the carton side walls. This movement insures proper contact between all suction cups 61 and the carton side walls 61, and reduces misalignment and vacuum cup wear possible when the cups strike the carton side walls at an angle less than 90°. Cam track portions 115 and 116 are mirror images of one another, and direct their associated carton engaging assemblies inwardly toward carton C so that vacuum suction cups 61 of each assembly are compressed to the maximum extent against opposite side walls W and W' of a fully collapsed carton or basket.

The suction cups 61 associated with each opening assembly 50 are arranged depending upon the size, type and other characteristics of the carton or basket to be opened. Not only size, but other physical characteristics such as cut-outs or windows must be taken into account when designing the vacuum plates and arrangement of suction cups 61. Also, the suction cups of opposed vacuum plates preferably are not placed in a position that would permit engagement between two opposed suction cups under any circumstances. Such engagement could cause damage to the opening assemblies under certain conditions.

Cam track 87 includes an elongate straight section 117 which is substantially parallel to longitudinal path A of opening assembly 10, which is the same as the longitudinal path of conveyor 11. During the longitudinal travel of opening assembly 50 through cam track section 117, the slide shaft 55 of opening assembly 50 traveling through cam track 87 does not reciprocate inwardly or outwardly, but holds its horizontal position while the carton side wall W adjacent to cam 86 is held to suction cups 61 by the vacuum applied to this opening assembly 50. In position III, although opening assembly 50 associated with cam 86 maintains its horizontal position, opening assembly 50 associated with cam 70 is retracted outwardly, away from the longitudinal path Δ of opening assembly 10, by the action of cam follower 64 in section 119 of cam track 71. As illustrated in FIG. 8, cam track section 119 is directed or slopes away from longitudinal path L. Since the suction cups 61 of opening assembly 50 associated with cam 70 are fixed by vacuum against the side wall W' of carton C, the outward reciprocation of slide shaft 55 associated with cam track 71 shown at position III begins to pull the carton side wall outwardly, opening carton C. This retraction of this slide bar 55 continues until carton C is fully opened, as shown in position IV. Therefore, the carton C has been fully opened while moving at machine speed through opening assembly 10 of packaging machine P. Thus, the action of assembly 10 tracks the movement or moves in a timed relationship with of carton C by conveyor 11 as the opening sequence is accomplished.

At this fully opened position, the conveyor 11*a* (FIG. 7), engages flap 120 of carton C with lugs 121, and the force resulting by the vacuum applied to each opposing carton opening assembly is simultaneously released, so that control of the carton movement continuing through packaging machine P is assumed by conveyor 11. The action of lugs 110 and 121 on the carton flaps 111 and 120 holds the carton in a fully opened position until the carton is delivered to the next workstation of packaging machine P, which transfers the carton to a mechanism that lowers the carton over a pre-formed bottle group. Optionally, opening assembly 10 could open the carton only to a partially opened condition prior to hand off to the conveyor. This would be accomplished simply by designing cam track 71 so that the associated carton engaging assemblies 50 do not retract to an extent so as to fully open the carton. Obviously, the conveyor 11*a* would be adjusted to accommodate a partially opened carton in this instance.

FIG. 8 illustrates that the datum or score line D of the carton side wall W closest to the maintenance side M of assembly 10 remains fixed, that is, the carton side wall W does not move inwardly or outwardly as the carton moves downstream through assembly 10 in the embodiment described above. The carton side wall W' adjacent to the operator side O of assembly 10, however, is not fixed, but is moved outwardly a distance approximately equal to two bottle diameters. Therefore the movement of cam follower 64 from position II to position IV through cam track 71 also is through a distance of approximately two bottle diameters. This is a preferred embodiment of the invention which is found to perform satisfactorily.

After opening assembly 10 has accomplished hand-off of the fully opened carton to conveyor 11 at position IV, each opposing carton engaging assembly 50 is moved outwardly an additional extent away from the respective carton side walls W and W' to prevent vacuum cup wear by friction of the vacuum cups on the carton side walls as the vacuum cups are moved upwardly around the head sprockets.

The present invention, however, also contemplates a variable datum line arrangement in which both sides of the carton, or carton side walls W and W', will be moved outwardly a distance equal to approximately a single bottle diameter as the carton or basket passes through opening assembly 10 in a downstream direction. To accomplish this second embodiment of the invention, the profile of lower cam 86 is changed to be a mirror image of profile of lower cam 70, and cam tracks 71 and 87 would identically move outwardly a sufficient extent to open each side W and W' of the carton or basket a distance equal to only one bottle diameter each, to fully open the basket prior to hand-off to conveyor 11. In this second embodiment, the carton engaging assemblies are identical in structure and in stroke. The present invention also can be designed to accommodate numerous machine pitches and bottle diameters for product groups which utilize different size cartons, by making the head and tail sprockets either larger or smaller. The embodiment chosen to illustrate the present invention is designed for a 15 inch pitch packaging machine having 5 opening assemblies on each side driven by a 75 inch chain. For a different pitch packaging machine, more or less opening assemblies would be utilized. In that event, vacuum distribution sprockets or manifolds having the same number of distribution ports as the number of opening assemblies would be used. If cartons for bottles of a different diameter are processed through the opening assembly, the shorter carton conveyor 11*a* may need to be adjusted inwardly or outwardly to accommodate the different bottle diameter. Also, the present invention is not limited to two pairs of head and tail sprockets driving the carton engaging assemblies. A different number of such sprockets could be used.

It will be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. In an article packaging machine having a carton opening assembly including a carton engaging assembly which releasably attaches to a paperboard carton, a method of opening a paperboard carton having opposed side walls in a collapsed state, comprising the steps of:

(a) moving the carton at a carton velocity in a longitudinal path from an upstream position to a downstream position prior to engagement with the carton engaging assembly;

(b) contacting each of the opposed carton side walls by moving the carton engaging assembly in a direction perpendicular to the longitudinal path, while simultaneously moving the carton and the carton engaging assembly in timed relationship along the longitudinal path at the carton velocity;

(c) pulling the carton open from a collapsed state to an opened state while the carton and the carton engaging assembly continue to be moved in timed relationship along the longitudinal path at the carton velocity.

2. The method of claim 1, further comprising the step of:

moving the carton along the longitudinal path at a uniform speed from where the carton is in a collapsed state to when the carton is in an opened state.

3. The method of claim 1, comprising the further step of:

disengaging the carton engaging assembly from the carton after the carton is opened.

4. The method of claim 1, comprising the further step of:

providing first and second carton engaging assemblies disposed opposite one another, wherein the carton is disposed therebetween and wherein each carton engaging assembly faces a carton side wall;

moving the first and second carton engaging assemblies perpendicularly away from each other to pull the carton from a collapsed state to an open state along the longitudinal path.

5. The method of claim 1 comprising the further step of maintaining the first carton engaging assembly at a predetermined distance from the carton while the carton moves in the downstream direction; and moving the second carton engaging assembly perpendicularly away from the first carton engaging assembly to pull the carton from a collapsed state to an open state along the longitudinal path.

6. The method of claim 1 comprising the further step of:

providing for a plurality of carton engaging assemblies along the longitudinal axis; and opening one carton per carton engaging assembly.

7. In an article packaging machine having a conveyor for conveying a carton having opposed sidewalls from an upstream direction to a downstream direction along a longitudinal path at a carton velocity, a carton opening assembly for opening the carton by moving the opposed side walls from a collapsed state to an opened state as the carton moves along the longitudinal path, said carton opening assembly comprising:

(a) a carton engaging assembly positioned to contact a carton side wall by movement of the carton engaging assembly in a direction perpendicular to the longitudinal path;

(b) a transport mechanism attached to the carton engaging assembly for moving the carton engaging assembly along the longitudinal path at the carton velocity, as the carton engaging assembly simultaneously is moved in a direction perpendicular to the longitudinal path; and (c) a cam positioned to contact said carton engaging assembly and adapted to cause said carton engaging assembly to engage the carton side walls after the carton begins to move in the downstream direction, and in a direction which is perpendicular to said longitudinal path.

8. The carton opening assembly of claim 7, said carton engaging assembly comprising a support block, a slide bar carried by said support block for slidable movement with respect to said support block, and a vacuum assembly attached to said slide bar for engaging a side wall of said carton.

9. The carton opening assembly of claim 7 further comprising:

a plurality of carton engaging assemblies along the longitudinal axis, wherein each carton opening assembly opens a separate carton; and a drive assembly for driving each carton engaging assembly.

10. The carton opening assembly of claim 9 wherein:

the drive assembly comprises a first chain mounted on first and second drive sprockets, wherein the first chain is fastened to the carton engaging assemblies, and wherein at least one of the first and second drive sprockets imparts movement to the first chain to drive the carton engaging assemblies.

11. The carton opening assembly of claim 10 wherein the drive assembly further comprises:

a support block within each engaging assembly, the support block being mounted onto the first chain, the support block further including a longitudinal channel disposed in a perpendicular orientation with respect to the longitudinal axis; and a slide bar adapted to be slidably received within the longitudinal channel, the slide bar having first and second ends, the slide bar including a cam follower disposed on the first slide bar end, and a vacuum plate disposed at the second slide bar end, the vacuum plate including a plurality of suction cups for engaging the carton, whereby the slide bar slides within the support block longitudinal channel to engage the carton with the suction cups as the cam follower follows the cam during chain rotation.

12. The carton opening assembly of claim 11 wherein the drive assembly further comprises:

a vacuum valve for selectively providing a vacuum to each of the suction cups on the suction plates within the carton engaging assemblies, and each of the carton engaging assemblies including a vacuum line, wherein the vacuum lines are adapted to transmit a vacuum from the vacuum valve to the carton engaging assemblies;

whereby the vacuum valve provides suction to a carton engaging assembly when the carton is in the collapsed state in an upstream position and removes suction when the carton is in a fully opened state in a downstream position.

13. The carton opening assembly of claim 11 wherein the drive assembly further comprises:

a second chain mounted on third and forth sprockets and disposed laterally to the first chain, such that the first and second chains form a pair of chains; and wherein the support block is mounted to the first and second chains to provide cantilever support to the slide bar.

14. In an article packaging machine having a carton feeder disposed along a longitudinal path defined by a carton conveyor and for feeding a carton in a collapsed state to the carton conveyor as the carton conveyor moves the collapsed carton along the longitudinal path at a selected rate, a carton opening assembly positioned along said longitudinal path for receiving the carton in a collapsed state from the carton conveyor and opening the carton, the carton opening assembly comprising:

at least two opposed carton engaging assemblies disposed on each side of the longitudinal path, a drive assembly connected to said carton engaging assemblies for moving said carton engaging assemblies along the longitudinal path at the same rate as the rate of the carton, wherein two carton opening assemblies are positioned along opposing sides of the carton as the carton is conveyed through the carton engaging assembly, and a cam track associated with each carton engaging assembly, wherein the cam track directs at least one carton engaging assembly toward the carton in a direction perpendicular to the longitudinal path as the carton engaging assemblies move along the longitudinal path from an upstream position to a downstream position, wherein said carton engaging assemblies engage opposing sides of the carton after the carton conveyor engages and begins movement of the carton in the downstream direction, thereby eliminating relative longitudinal movement between the carton and the carton engaging assembly, whereby said carton engaging assembly opens the carton as the carton moves along the longitudinal path.

15. The carton opening assembly of claim 14 further comprising:

a plurality of opposed pairs of carton engaging assemblies arranged along the longitudinal axis wherein each pair engages a separate carton; and a drive assembly for driving each carton engaging assembly pair.

16. The carton opening assembly of claim 15 wherein the drive assembly further comprises:

a first chain mounted on a first pair of drive sprockets, the first chain for driving a first carton engaging assembly within each pair of opposed carton engaging assemblies; and a second chain mounted on a second pair of drive sprockets, the second chain for driving the second carton engaging assembly within each pair of opposed carton engaging assemblies.

17. The carton opening assembly of claim 16 wherein the drive assembly further comprises:

a support block within each carton engaging assembly, the support block being mounted onto the chain from which carton engaging assembly extends, the support block further including a longitudinal channel disposed perpendicular to the longitudinal axis; and a slide bar adapted to be slidably received within the longitudinal channel, the slide bar having first and second ends, the slide bar including a cam follower disposed on the first slide bar end, and a vacuum plate disposed at the second slide bar end, the vacuum plate including a plurality of suction cups for engaging the carton, whereby the slide bar slides within the support block longitudinal channel to engage the carton with the suction cups as the cam follower follows the cam during chain rotation.

18. The carton opening assembly of claim 17 wherein the drive assembly further comprises:

a vacuum valve for selectively providing suction to each of the suction plates within the carton engaging assembly.

19. The carton opening assembly of claim 15 wherein the cam associated with each opposing pair of carton engaging assemblies is configured to move the first and second carton engaging assemblies within each pair of carton engaging assemblies perpendicularly away from each other to pull cartons from a collapsed state to an open state along the longitudinal path.

20. The carton opening assembly of claim 15 wherein the cam associated with each opposing pair of carton engaging assemblies is configured to maintain the first carton engaging assembly within each opposing pair of carton engaging assemblies at a predetermined, constant distance from the carton, after engaging the carton, while the carton moves in the downstream direction; and moving the second carton engaging assembly perpendicularly away from the first carton engaging assembly within each pair of opposed carton engaging assemblies to pull the carton from a collapsed state to an open state along the longitudinal path.

* * * * *